US009472915B1

(12) United States Patent
Jaeger

(10) Patent No.: US 9,472,915 B1
(45) Date of Patent: Oct. 18, 2016

(54) SPRING RING CIRCUIT ASSEMBLY

(71) Applicant: NOVAWURKS, INC., Los Alamitos, CA (US)

(72) Inventor: Talbot Jaeger, Los Alamitos, CA (US)

(73) Assignee: NOVAWURKS, INC., Los Alamitos, CA (US)

( * ) Notice: Subject to any disclaimer, the term of this patent is extended or adjusted under 35 U.S.C. 154(b) by 0 days.

(21) Appl. No.: 14/710,195

(22) Filed: May 12, 2015

(51) Int. Cl.
*H01R 39/64* (2006.01)

(52) U.S. Cl.
CPC ..... *H01R 39/643* (2013.01)

(58) Field of Classification Search
CPC ..... H01R 39/64; H01R 39/643
See application file for complete search history.

(56) References Cited

U.S. PATENT DOCUMENTS 1,176,554 A * 3/1916 Herzig ..... H01R 39/643 439/17
3,234,495 A 2/1966 Martinez
3,489,982 A 1/1970 Dauphinee
4,098,546 A * 7/1978 Swartz ..... H01R 39/643 310/231
4,294,500 A 10/1981 Wilson
4,372,633 A * 2/1983 Allen ..... H01R 39/64 310/232
4,447,752 A 5/1984 Boyce et al.
4,708,658 A 11/1987 Kapler et al.
5,178,546 A 1/1993 Dickerson
5,501,604 A 3/1996 Roopnarine et al.
5,829,986 A * 11/1998 Kong ..... H01R 39/643 439/13
6,612,847 B2 9/2003 Canizales, Jr.
6,921,269 B2 7/2005 Johnson et al.
7,811,091 B2 10/2010 Koyama

* cited by examiner

*Primary Examiner* — James Harvey
(74) *Attorney, Agent, or Firm* — Russo & Duckworth, LLP; David G. Duckworth

(57) ABSTRACT

A spring ring circuit assembly is provided for transmitting electricity between a first structure and a second structure which rotates relative to the first structure. The spring ring circuit assembly includes a spring ring which is affixed to and concentrically positioned around a spindle. The spring ring circuit assembly further includes a circular band concentrically positioned around the spring ring so as to create an annular space between the spring ring and circular band. The spring ring circuit assembly further includes an inner set of rollers positioned around and engaging the spring ring, and an outer set of rollers positioned within and engaging the circular band. The spring ring, rollers and circular band are made of electrically conductive materials so as to allow electricity to transmit between the spring ring and the circular band which is capable of rotating around the spring ring.

14 Claims, 3 Drawing Sheets

SPRING RING CIRCUIT ASSEMBLY

This invention was made with government support under contract no. HR0011-14-C-0023 awarded by the Defense Advanced Research Projects Agency. The government has certain rights in the invention.

BACKGROUND OF THE INVENTION

The present invention relates generally to mechanisms providing for the transmission of power and electrical signals between a stationary structure and a rotating structure.

There has long been difficulty in transmitting power and electrical signals between a stationary object and a rotating structure. A well-known structure for accomplishing this is a "slip ring". Typically, a slip ring includes a metal contact, referred to as a brush, which rubs on the circumferential or radial surface of a rotating metal ring. As the metal ring rotates, an electrical current is conducted through the stationary brush. If more than one electric circuit is required, additional ring and brush assemblies are coaxially positioned and stacked to rub against the radial surface or against the circumferential surface. Either the brush or the ring may be stationary.

Unfortunately slip rings suffer from several disadvantages. A slip ring's brush works by a wiping action wherein a brush's contact finger directly abuts against an opposing terminal as the contact surface rotates. The wiping action can create wear on both the finger and contact surface. Excessive wear results in the need to readjust the finger or its contact surface to compensate for the wear and ensure a proper electrical contact. Similarly, the excessive wear can cause debris which contaminates the area of the brush contact. The debris may cause electrical shorts, jam sensitive mechanical movements, and require excessive preventative maintenance.

Furthermore, typically the finger of the brush contact is formed so as to operate in only one direction of rotation. However, rotating platforms sometimes jam or otherwise require attention. In such situations, it is often desirable to rotate the platform in a direction opposite its normal mode of operation. Such manipulation may help to unjam the machine, but the reverse rotation can bend and destroy traditional brush contacts. The damaged contact then needs to be replaced or repaired before the rotating platform can again function properly.

More recently, roll rings have been developed to overcome some of the disadvantages of slip rings for transmitting electrical signals and power from a stationary object to a rotating object. Instead of brushes, the electrical contact incorporates wheels, spheres, or roller bearings which roll so as to reduce wear and friction. However, in order to maintain the wheels or roller bearings in proper space and orientation, a mechanical assembly must be employed to maintain the wheels or roller bearings in proper position and alignment. Unfortunately, this mechanical assembly to position the wheels or roller bearings introduces unwanted weight and cost, and inhibits scalability.

Thus, it would be desirable to provide a circuit assembly for transmitting electricity between a non-rotating structure and a rotating structure that is not subject to the wear and friction of metal brushes.

Moreover, it would be desirable to provide a circuit assembly for transmitting electricity between a non-rotating object and a rotating object that does not introduce unwanted weight and cost, or inhibit scalability.

SUMMARY OF THE INVENTION

The present invention addresses the aforementioned disadvantages by providing an improved mechanism, referred to herein as a "spring ring" circuit assembly to transmit electricity, such as electrical signals and/or power, between a first structure and a second structure which rotates relative to the first structure. Advantageously, the spring ring circuit assembly of the present invention has broad application throughout any industry wherein it is desirable to transmit electricity between structures that rotate relevant to one another. For purposes herein, one of the structures will be referred to herein as a non-rotating structure and one of the structures will be referred to as a rotating structure. However, as understood by those skilled in the art, whether an object is rotating or not rotating simply depends on one's reference point. Accordingly, the terms "non-rotating structure" and "rotating structure" are for simplicity and explanatory purposes only. The use of these terms is not intended to be limiting.

The spring ring circuit assembly includes a first structure and a second structure which rotates relative to the first structure. The first structure includes a spindle in the form of an elongate rod or the like having a substantially circular cross-section. In addition, the spring ring circuit assembly includes a spring ring which is affixed and positioned around the circular spindle. The spring ring has a substantially circular structure and is concentrically affixed around the spindle so as to not rotate relative to the spindle. The spring ring includes an opening so as to not form a complete circle so as to allow the spring ring to contract inward or expand outward. Preferably, the opening extends at an angle relative to the spring ring's central axis. In addition, the spring ring is manufactured of an electrically conductive material so that its exterior circumferential surface is capable of transmitting electricity through the spring ring to an electrical contact. The electrical contact may be located anywhere on the spring ring. However, preferably the spring ring's interior circular surface provides an electrical contact for connecting to wiring located on the first structure.

The spring ring circuit assembly also includes a circular band which is positioned concentrically around the spindle and spring ring. The circular band has a diameter substantially greater than the diameter of the spring ring so as to form an annular space. Like the spring ring, the circular band is also made of an electrically conductive material so that its inner circular surface is electrically conductive.

Within the annular space between the spring ring and the circular band, the spring ring circuit assembly includes at least two sets of rollers. The rollers may be constructed to have any shape that rolls including spherical shapes and ellipsoid shapes. Alternative roller constructions may include cylinders having opposed flat circular sides and one curved "circumferential" side. In still alternative embodiments, the rollers have concave or convex circumferential surfaces, or alternating concave and convex circumferential surfaces. However, it is preferred that the rollers be constructed as short hollow cylinders to form a circular shape. A first set of "inner" rollers is positioned around the spring ring so as to engage the spring ring forming an annular configuration. Meanwhile, the rollers include at least a second "outer" set of rollers positioned within the circular band and engaging the circular band in an annular configuration.

Importantly, each roller in a set is positioned to not engage another roller in its set. Thus, each of the rollers in the inner set which engage the spring ring do not engage one another. Similarly, each of the rollers in the outer set of rollers are positioned so as to not engage another roller in the outer set of rollers. In a first embodiment, this is accomplished by the inner set of rollers engaging the outer set of rollers wherein each inner roller engages and separates two outer rollers, and similarly each of the outer rollers engages and separates two inner rollers so as to prevent them from engaging one another. In non-preferred embodiments, the spring ring circuit assembly includes additional intermediary sets of rollers wherein the rollers of an intermediary set engages inner rollers and outer rollers so as to separate the rollers of each set from engaging one another.

The spring ring is sized and constructed in a manner of spring so as to expand outward from the first structure's spindle due to inherent stored mechanical memory. However, the rollers are sized and positioned so as to compress the spring ring from its natural uncompressed state to a compressed state wherein the spring ring attempts to force the inner and outer sets of rollers outward until the rollers are constrained by the circular band. In this manner, the spring ring maintains engagement with the inner set of rollers, which in turn is forced outward so as to engage a next set of rollers, which is preferably the outer set of rollers, which in turn is forced outwardly so as to engage the circular band.

The spring ring, circular band and rollers are electrically conductive so that electricity can be transmitted between the spring ring and circular band through the inner and outer sets of rollers. Advantageously, as the circular band rotates concentrically relative to the spring ring, the inner set of rollers and outer set of rollers will rotate while maintaining engagement and electrical connection to one another while still maintaining contact with the spring ring and circular band so as to enable the transmission of electricity between the spring ring and circular band. Advantageously, no additional mechanical apparatus is required to separate adjacent rollers in the inner set of rollers so as to prevent them from engaging one another. Similarly, no additional mechanical apparatus is required to ensure that adjacent rollers in the outer set of rollers do not engage one another.

Preferably, the spring ring has an electrical contact for connecting to a wire or the like. In a preferred embodiment, the entire spring ring is electrically conductive and can form as an electrical contact for connecting to a wire or wiring for transmitting electricity through a first structure. Similarly, the circular band includes a contact, which may be its entire circumferential surface, for connecting to electrical wiring for transmitting electricity through the second structure which rotates relative to the first structure.

Preferably, the spring ring, inner and outer sets of rollers, and circular band are structurally confined to stay substantially within a plane. In a first preferred embodiment, the inner rollers may be constructed to have convex outer circumferential surfaces to mate within concave outer circumferential surfaces of the outer rollers (or vice versa) so as to longitudinally lock the rollers within a plane. However, in a preferred embodiment, the spring ring, circular band, inner set of rollers and outer set of rollers are cylindrical and sandwiched between two insulator plates made of non-electrically conductive material. The two layers of non-electrically conductive material prevent shorting with adjacent circuits. Moreover, the layers of non-electrically conductive material maintain the respective spring ring, rollers and circular band in proper placement and alignment, and provide surfaces between which the rollers can slide. In still an alternative embodiment, the inner rollers are constructed to have convex outer circumferential surfaces to mate within concave outer circumferential surfaces of the outer rollers (or vice versa), and the rollers are sandwiched between insulator plates of non-electrically conductive material so as to prevent electrical shorting and provide additional structure preventing longitudinal movement of the rollers.

Other features and advantages of the present invention will be apparent to those skilled in the art upon reading the detailed description which follows with reference to the attached drawings.

DETAILED DESCRIPTION OF THE PREFERRED EMBODIMENTS

Figure 1:
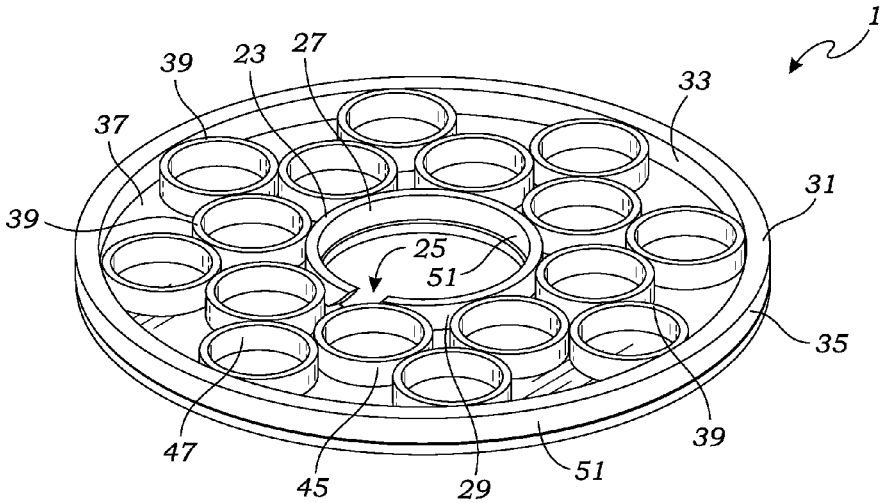
FIG. 1 is a perspective view of the spring ring circuit assembly of the present invention.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

Figure 2:
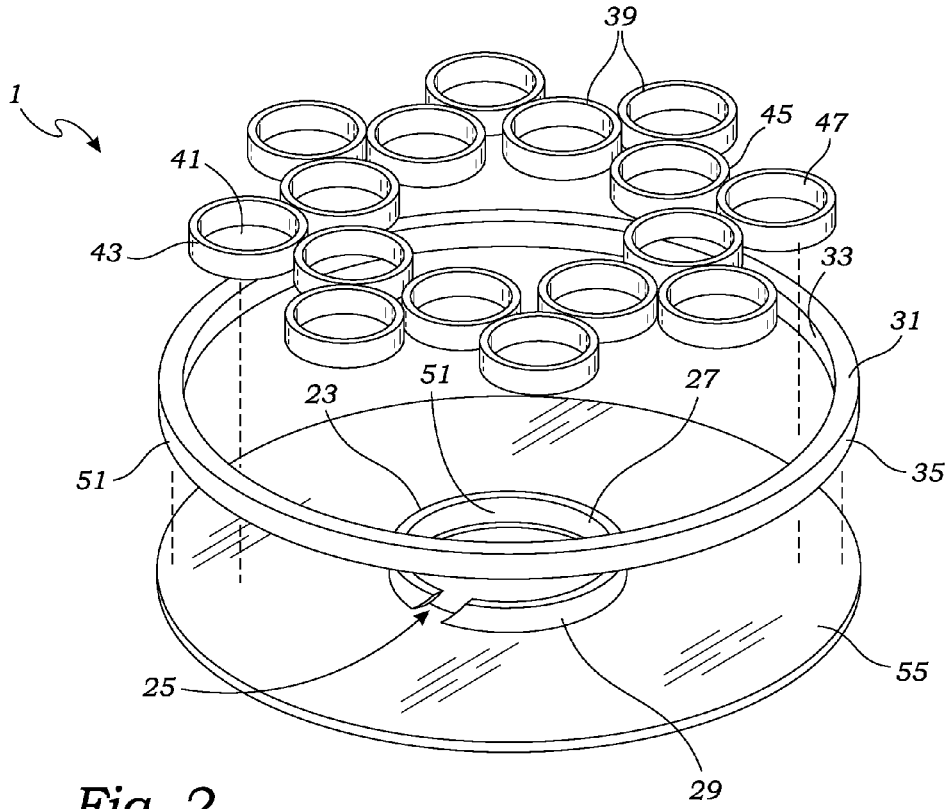
FIG. 2 is a perspective, partially exploded view of the spring ring circuit assembly illustrated in FIG. 1.

With reference to FIGS. 1-4, the spring ring circuit assembly 1 provides for one or more electrical circuits for transmitting power or electrical signals between a stationary first structure and a rotating second structure. A preferred spring ring circuit assembly 1 for providing a single electrical pathway is illustrated in FIGS. 1 and 2. As illustrated in these figures, the spring ring 1 circuit assembly includes a spring ring 23 having a substantially circular structure. The spring ring is affixed to a first structure 3 by concentrically mounting the spring ring to a pillar-like structure referred to herein as a spindle 9, illustrated in FIGS. 3 and 4. In addition, the spring ring is made of an electrically conductive material so as to provide an electrical contact 51, which may be the entire interior surface 27 of the spring ring 23. Importantly, the spring ring includes an opening 25 so as to allow the ring to expand and contract in a manner of a spring. As illustrated in FIG. 2, preferably the opening 25 extends at an angle relative to the spring ring's central axis.

The spring ring circuit assembly 1 further includes a circular band 31 which is concentrically positioned around the spindle 9 and spring ring 23. The circular band 31 has a diameter substantially greater than the diameter of the spring ring 23 so as to create an annular space 37 between the spring ring and circular band. The circular band is also made of an electrically conductive material so as to provide an electrical contact for connecting to electrical circuitry located on a second structure. The circular band's electrical contact 51 may take the form of one or more locations on the circular band's cylindrical exterior surface 35.

The spring ring circuit assembly 1 includes at least two sets of concentrically and annularly configured rollers positioned within the annular space 37 between the spring ring 23 and circular band 31. The rollers are preferably cylindrical having a center hole 41. As illustrated in FIGS. 1 and 2, the rollers 39 are arranged in the annular space to provide an inner set 45 of rollers 39 positioned so as to engage the spring ring's exterior surface 29. Each of the rollers 39 in the inner set 45 are positioned to not engage one another. Meanwhile, the spring ring's circuit assembly's outer set 47 of rollers 39 are positioned within the annular space 37 so that each roller's cylindrical outer surface 43 engages the circular band's interior surface 33. Similarly, the rollers of the outer set 47 are positioned in the annular space 37 to not engage one another.

The inner set 45 and outer set 47 of rollers may include any number of rollers. However, the inner set of rollers 45 has the same number of rollers as the outer set 47 because each roller 39 of the outer set is positioned to engage and separate two of the rollers within the inner set. Conversely, each of the rollers 39 within the inner set 45 are positioned to engage and separate two rollers 39 in the outer set 47.

Within the spring ring's circuit assembly 1, the spring ring 23 is placed in a compressed state so as to store mechanical memory. The spring ring maintains its compressed state by engaging the inner set 45 of rollers, which in turn engages the outer set 47 of rollers, which in turn engages and is constrained by the interior surface 33 of the circular band 31.

Preferably, the spring ring, inner and outer sets of rollers, and circular band are sandwiched between insulator plates 55 so as to maintain each of these elements substantially within a plane. The insulator plates may be made from various materials as can be determined by those skilled in the art including plastics. However, a preferred insulator plate is made from Guerilla Glass® which is a toughened glass manufactured and sold by Corning Inc. Meanwhile, preferably the spring ring 23, rollers 39 and circular band 31 are made of electrically conductive materials. Suitable materials for manufacturing the spring ring, rollers and circular band can be selected by those skilled in the art. However, in preferred embodiments, each of these structures are made of gold plated aluminum.

In use, the spring ring 23 is affixed to a first structure 3 and the circular band 31 is affixed to a second structure (not shown) which rotates relative to the first structure. Advantageously, the circular band 31 maintains redundant electrical connection with the spring ring 23 through the various rollers 39. As but one example, as illustrated in FIGS. 1 and 2, both the inner set of rollers 45 and the outer set of rollers 47 possess eight rollers 39. Accordingly, the circular band 31 and spring ring 23 are connected by at least eight contact points. Moreover, the angled configuration of the spring ring's opening 25 enables a roller 39 to maintain contact with the spring ring 23 even when rolling over the spring ring's opening 25.

Figure 3:
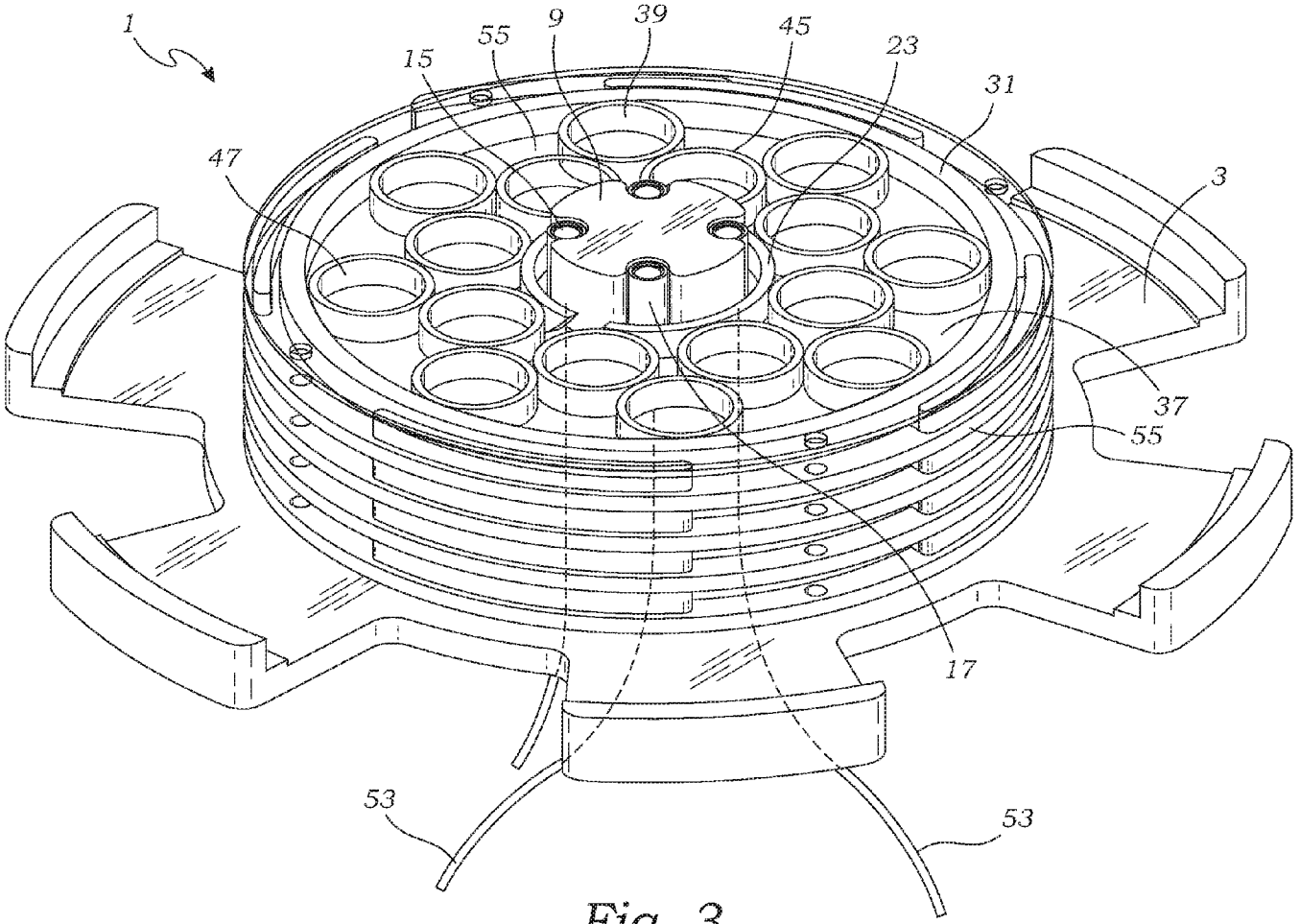
FIG. 3 is a perspective view of four spring ring circuit assemblies for providing four different electrical circuits between a first structure and a second structure which rotates relative to the first structure.
Figure 4:
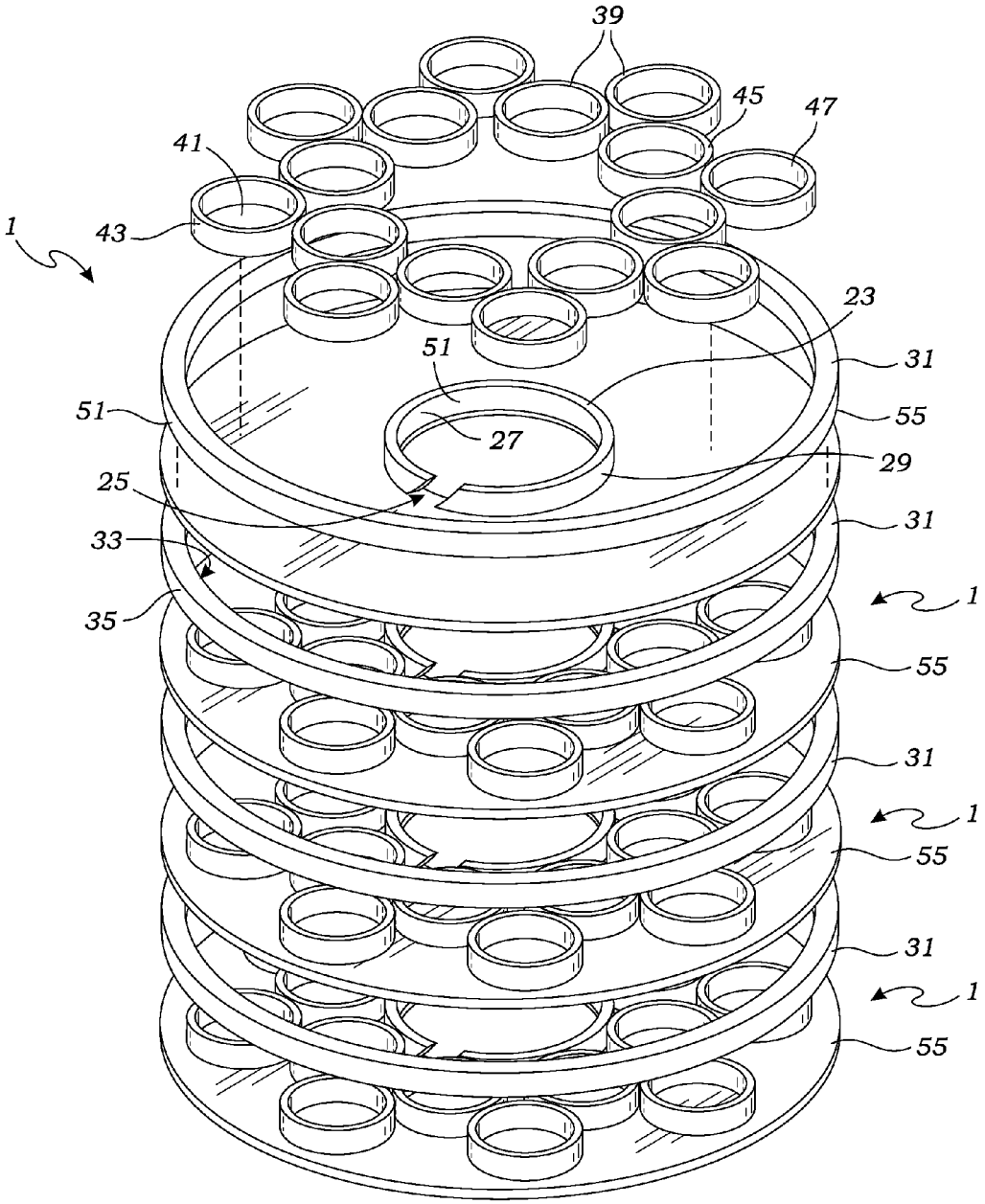
FIG. 4 is a perspective, partially exploded view of the spring ring circuit assemblies illustrated in FIG. 3.

Advantageously, any number of spring ring circuit assemblies 1 can be stacked upon one another to provide any number of circuits between a first structure and second structure which rotates relative to the first structure. For example, FIGS. 3 and 4 illustrate a mechanism including four spring ring circuit assemblies 1 for providing four electrical pathways between a non-rotating structure and a rotating structure. The mechanism includes a first structure 3 having a base and a spindle 9. The spindle is substantially cylindrical so as to define a longitudinal axis. For this embodiment, the spindle 9 is made of a substantially non-conductive material and is formed with four slots 15 wherein each slot receives an electrically conductive post 17. As best illustrated in FIG. 4, the mechanism includes four spring ring circuit assemblies 1 with each assembly including a spring ring 23, an inner set of rollers 45, an outer set of rollers 47, and a cylindrical band 31. Each spring ring assembly 1 is separated from an adjacent spring ring assembly 1 by an insulator plate 55 so as to isolate each circuit. Meanwhile, each post 17 is electrically connected to a single spring ring, and thus each post 17 connects to only one of the four respective spring ring circuit assemblies 1. In addition, each post 17 electrically connects to circuitry found on the first structure 3, such as individual wires 53 illustrated in FIG. 3. Meanwhile, each of the four circular bands 31 connects to electrical circuitry found in the second structure (not shown) which rotates relative to the first structure 3 and its spindle 9.

The spring ring circuit assemblies are not subject to significant friction or resulting wear. Further, the spring ring circuit assemblies do not include any additional mechanical apparatus to prevent adjacent rollers in a set from engaging one another.

While several particular forms of the invention have been illustrated and described, it will be apparent that various modifications can be made without departing from the spirit and scope of the invention. Therefore, it is not intended that the invention be limited except by the following claims.

Having described my invention in such terms so as to enable persons skilled in the art to understand the invention, recreate the invention and practice it, and having presently identified the presently preferred embodiments thereof, I claim:

1. A spring ring circuit assembly for transmitting electricity between a non-rotating structure and a rotating structure comprising:

a first structure, said first structure having a spindle;

a second structure rotatable relative to said first structure;

a spring ring non-rotatably affixed to and positioned around said spindle, said spring ring being substantially circular to form a circular structure but including an opening in said spring ring's circular structure to allow said spring ring to contract inward and expand outward;

a first electrical contact electrically connected to said spring ring;

a circular band affixed to said second structure and concentrically positioned around said spring ring;

a second electrical contact electrically connected to said circular band;

an inner set of rollers positioned around and engaging said spring ring so as to form an annular configuration with adjacent rollers in said inner set of rollers not engaging one another;

an outer set of rollers positioned within and engaging said circular band so as to form an annular configuration with adjacent rollers in said outer set of rollers not engaging one another;

said circular band rotatable relative to said spring ring and spindle with the rotation of said inner and outer sets of rollers, and wherein said spring ring is in a compressed state so as to force said inner and outer sets of rollers outward until constrained by said circular band; and said spring ring, said rollers, and said circular band being electrically conductive, and said inner and outer rollers electrically connected to allow electricity to transmit between said first electrical contact and said second electrical contact through said spring ring, said inner and outer sets of rollers, and said circular band.

2. The spring ring circuit assembly for transmitting electricity between a non-rotating structure and a rotating structure of claim 1 wherein said rollers are hollow cylinders forming circular structures.

3. The spring ring circuit assembly for transmitting electricity between a non-rotating structure and a rotating structure of claim 1 wherein said rollers are positioned between layers of non-electrically conductive material.

4. The spring ring circuit assembly for transmitting electricity between a non-rotating structure and a rotating structure of claim 1 wherein said rollers are positioned between layers of non-electrically conductive glass.

5. The spring ring circuit assembly for transmitting electricity between a non-rotating structure and a rotating structure of claim 1 wherein:

said inner rollers engage said outer rollers so that said inner rollers separate adjacent outer rollers to prevent adjacent outer rollers from engaging one another and said outer rollers separate said inner rollers to prevent adjacent inner rollers from engaging one another, and said inner rollers engage said outer roller so that the rotation of said inner rollers in a first direction causes said outer rollers to rotate in the opposite direction.

6. The spring ring circuit assembly for transmitting electricity between a non-rotating structure and a rotating structure of claim 1 further comprising a third set of electrically conductive rollers positioned between said inner set of rollers and said outer set of rollers, said third set of rollers electrically conductive to conduct electricity between said inner and out set of rollers.

7. A pair of electric circuits for simultaneously transmitting a plurality of electrical signals between a non-rotating structure and a rotating structure comprising:

a first structure, said first structure having a spindle;

a first electric circuit including;

a first spring ring non-rotatably affixed to and positioned around said spindle, said first spring ring being substantially circular to form a circular structure but including an opening in said first spring ring's circular structure to allow said first spring ring to contract inward and expand outward;

a first electrical contact electrically connected to said first spring ring;

a first circular band concentrically positioned around said first spring ring;

a second electrical contact electrically connected to said first circular band;

a first inner set of rollers positioned around and engaging said first spring ring so as to form an annular configuration with adjacent rollers in said first inner set of rollers not engaging one another;

a first outer set of rollers positioned within and engaging said first circular band so as to form an annular configuration with adjacent rollers in said first outer set of rollers not engaging one another;

said first circular band rotatable relative to said first spring ring and spindle with the rotation of said first inner and first outer sets of rollers, and wherein said first spring ring is in a compressed state so as to force said first inner and first outer sets of rollers outward until constrained by said first circular band; and said first spring ring, said first inner and first outer rollers, and said first circular band being electrically conductive, and said first inner and first outer rollers electrically connected to allow electricity to transmit between said first electrical contact and said second electrical contact through said first spring ring, said first inner and first outer sets of rollers, and said first circular band;

a second electric circuit including;

a second spring ring non-rotatably affixed to and positioned around said spindle, said second spring ring being substantially circular to form a circular structure but including an opening in said second spring ring's circular structure to allow said second spring ring to contract inward and expand outward;

a third electrical contact electrically connected to said second spring ring;

a second circular band concentrically positioned around said second spring ring;

a fourth electrical contact electrically connected to said second circular band;

a second inner set of rollers positioned around and engaging said second spring ring so as to form an annular configuration with adjacent rollers in said second inner set of rollers not engaging one another;

a second outer set of rollers positioned within and engaging said second circular band so as to form an annular configuration with adjacent rollers in said second outer set of rollers not engaging one another;

said second circular band rotatable relative to said second spring ring and spindle with the rotation of said second inner and second outer sets of rollers, and wherein said second spring ring is in a compressed state so as to force said second inner and second outer sets of rollers outward until constrained by said second circular band; and said second spring ring, said second inner and second outer rollers, and said second circular band being electrically conductive, and said second inner and second outer rollers electrically connected to allow electricity to transmit between said third electrical contact and said fourth electrical contact through said second spring ring, said second inner and second outer sets of rollers, and said second circular band; and said second electric circuit is stacked upon said first electric circuit, and said first electric circuit and second electric circuit are separated by a layer of electrically non-conductive material.

8. The pair of electric circuits for transmitting electrical signals between a non-rotating structure and a rotating structure of claim 7 wherein said rollers are hollow cylinders forming circular structures.

9. The pair of electric circuits for transmitting electrical signals between a non-rotating structure and a rotating structure of claim 7 wherein said layer of non-electrically conductive material is made of glass.

10. The pair of electric circuits for transmitting electrical signals between a non-rotating structure and a rotating structure of claim 7 wherein:

said first set of inner rollers engage said first set of outer rollers so that the rotation of said first set of inner rollers in a first direction causes said first set of outer rollers to rotate in the opposite direction; and said second set of inner rollers engage said second set of outer rollers so that the rotation of said second set of inner rollers in a first direction causes said second set of outer rollers to rotate in the opposite direction.

11. A spring ring circuit assembly for transmitting electricity between a non-rotating structure and a rotating structure comprising:

a first structure, said first structure having a spindle;

a spring ring non-rotatably affixed to and positioned around said spindle, said spring ring being substantially circular to form a circular structure but including an opening in said spring ring's circular structure to allow said spring ring to contract inward and expand outward;

a first electrical contact electrically connected to said spring ring;

a circular band concentrically positioned around said spring ring;

a second electrical contact electrically connected to said circular band;

an inner set of rollers positioned around and engaging said spring ring so as to form an annular configuration;

an outer set of rollers positioned within and engaging said circular band so as to form an annular configuration;

said inner rollers engaging said outer rollers so that said inner rollers separate adjacent outer rollers to prevent adjacent outer rollers from engaging one another and said outer rollers separate said inner rollers to prevent adjacent inner rollers from engaging one another, and said inner rollers engage said outer roller so that the rotation of said inner rollers in a first direction causes said outer rollers to rotate in the opposite direction;

said circular band rotatable relative to said spring ring and spindle with the rotation of said inner and outer sets of rollers, and wherein said spring ring is in a compressed state so as to force said inner and outer sets of rollers outward until constrained by said circular band; and said spring ring, said rollers, and said circular band being electrically conductive, and said inner and outer rollers electrically connected to allow electricity to transmit between said first electrical contact and said second electrical contact through said spring ring, said inner and outer sets of rollers, and said circular band.

12. The spring ring circuit assembly for transmitting electricity between a non-rotating structure and a rotating structure of claim 11 wherein said rollers are hollow cylinders forming circular structures.

13. The spring ring circuit assembly for transmitting electricity between a non-rotating structure and a rotating structure of claim 11 wherein said rollers are positioned between layers of non-electrically conductive material.

14. The spring ring circuit assembly for transmitting electricity between a non-rotating structure and a rotating structure of claim 11 wherein said rollers are positioned between layers of non-electrically conductive glass.

* * * * *